US007004335B2

(12) United States Patent
Remmers

(10) Patent No.: US 7,004,335 B2
(45) Date of Patent: Feb. 28, 2006

(54) WIRE SHELF HAVING INTEGRATED HOOKS WITH HANGER ROD

(75) Inventor: Lee E. Remmers, Ocala, FL (US)

(73) Assignee: Clairson Inc., Newark, DE (US)

( * ) Notice: Subject to any disclaimer, the term of this patent is extended or adjusted under 35 U.S.C. 154(b) by 401 days.

(21) Appl. No.: 10/235,315

(22) Filed: Sep. 5, 2002

(65) Prior Publication Data

US 2004/0045920 A1 Mar. 11, 2004

(51) Int. Cl.
*A47F 5/00* (2006.01)

(52) U.S. Cl. ..... 211/90.03; 211/105.1; D6/511

(58) Field of Classification Search ..... 211/90.02, 211/90.03, 105.1, 181.1; D6/511
See application file for complete search history.

(56) References Cited

U.S. PATENT DOCUMENTS 3,688,915 A * 9/1972 Ramsey
3,972,499 A * 8/1976 Simmons
D349,000 S 7/1994 Rogers et al.
5,350,072 A 9/1994 Rogers et al.
D352,195 S 11/1994 Rogers et al.
D354,864 S 1/1995 Kokenge et al.
5,405,026 A * 4/1995 Lee et al. ..... 211/106 X
5,531,416 A * 7/1996 Remmers ..... 211/105.1
5,836,461 A 11/1998 Kokenge et al.
D419,344 S * 1/2000 Greene ..... D6/511

* cited by examiner

*Primary Examiner*—Robert W. Gibson, Jr.
(74) *Attorney, Agent, or Firm*—Harness, Dickey & Pierce, P.L.C.

(57) ABSTRACT

A shelf includes a plurality of integrated hook members supporting a rod member to provide free movement of items supported by the rod member. The hook members are integrally connected to support members of the shelf deck to support the rod member for use in, for example, hanging items thereon.

22 Claims, 5 Drawing Sheets

WIRE SHELF HAVING INTEGRATED HOOKS WITH HANGER ROD

FIELD OF THE INVENTION

The present invention relates generally to wire shelf storage systems, and more particularly to a wire shelf having a hanger rod integrally connected thereto.

BACKGROUND OF THE INVENTION

Efficient and organized use of building space is very desirable, particularly with respect to storage or utility space in businesses, residential homes and apartments. In particular, because of the limited or tight spaces in these locations, maximizing the amount of that space that is useable is very important. Likewise, providing ease in access and increased user convenience is important.

With respect to closet organization and the design of closet storage units, particularly for residential use, many different options are available including, for example, different sizes and shapes of shelves, different attachment and mounting members and different storage members (e.g., wire baskets, shoe-stands and tie/belt racks). Ease in accessing stored items, such as clothing, is important. Further, ease in moving stored items to make room for other items or to access items not readily accessible, is likewise important.

It is common today to use ventilated shelving (e.g., wire or plastic, and associated components) to construct storage units within closets. Typical ventilated shelving not only varies in size (e.g., different lengths and widths), and configuration (e.g., different wire mesh spacing), but may have connected thereto different storage or attachment members, including for example, a hanging shoe storage device or clothes on hangers. It is desirable for a single unit to include any such attachment or storage devices preassembled and connected thereto. In particular, and for example, having a single unit reduces installation time.

Shelving units with integrally connected storage or attachment devices are known. For example, different configurations for providing hanger rod attachments connected to wire shelving are known. However, these designs are often not user friendly, such as having the hanger rod located behind the front of the wire shelf, or attached in such a manner that makes construction difficult and/or is more likely to result in failure (e.g., attachment of hanger rod assembly to a single support member). Thus, although these shelves with integrated hanger rods provide for easier movement of items along a shelf, for example, sliding clothes on hangers, they are often difficult to access or are susceptible to failure, for example, when hanging heavier, bulky items thereon.

SUMMARY OF THE INVENTION

A shelf of the present invention provides a rod member integrally connected thereto using a plurality of hooks. Generally, the shelf includes a plurality of hook members together provided as a one-piece welded assembly to the shelf deck with a horizontally extending rod member attached to an end of each of the hook members to provide continuous free slide of items along the rod member.

In one embodiment, a wire shelf includes a plurality of wire stringers and support members forming a shelf deck, and a plurality of hook members configured for horizontal connection to the shelf deck and having a rod member connected thereto. The hook members may include a horizontal portion configured for connection to at least two support members (e.g., a front and an intermediate support member). Further, the hook members may include a plurality of curved portions.

In another embodiment a wire shelf with integral rod includes a plurality of longitudinally extending support wires, and a plurality of transversely extending wire stringers forming a shelf deck, a longitudinally extending rod, and a plurality of hooks secured to at least two of the longitudinally extending support wires, and supporting the rod. The plurality of hooks may include a concavely curved portion and a support surface to which the rod is secured, with the concavely curved portion configured to allow hangers on the rod to slide past the plurality of hooks without interference.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Although a shelf of the present invention may be described in connection with component parts having a particular size and shape, it is not so limited, and the size and shape of the various component parts may be modified as needed or desired.

Figure 1:
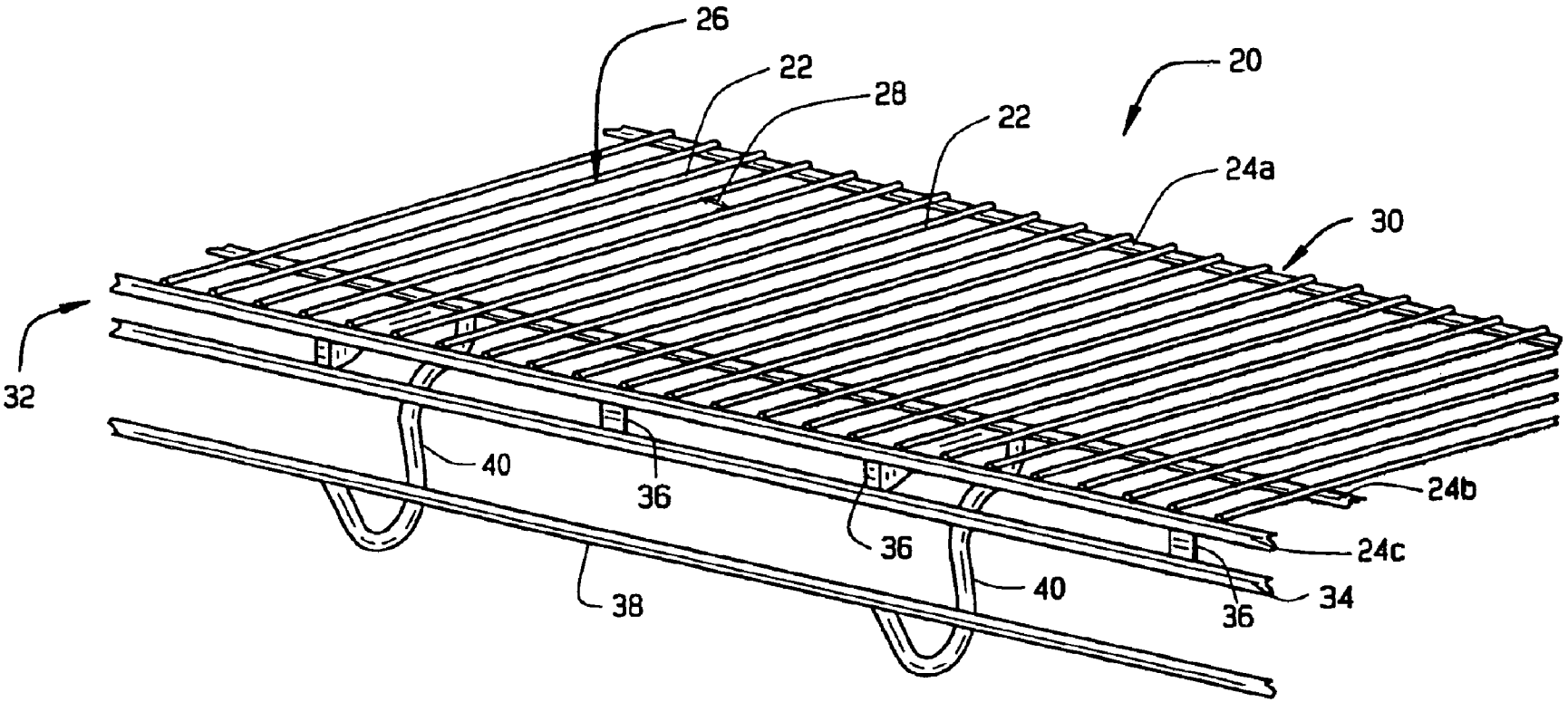
FIG. 1 is a top perspective view of a shelf having an integrated rod member connected thereto constructed according to principles of the present invention.
Figure 2:
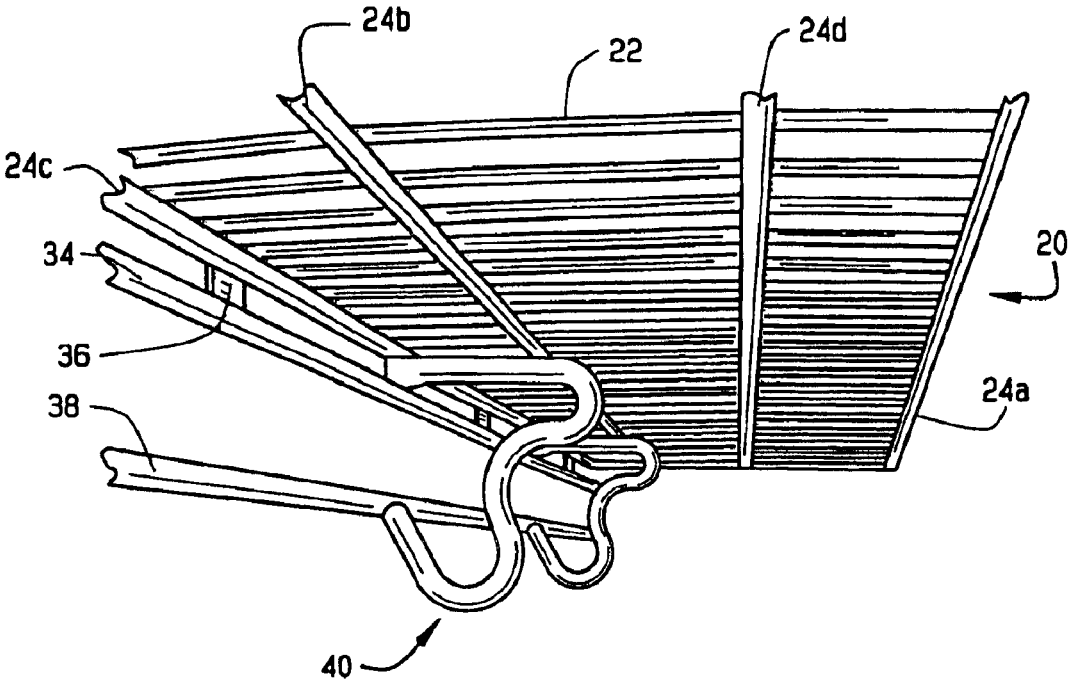
FIG. 2 is a bottom perspective view of a shelf having an integrated rod member connected thereto constructed according to the present invention.
Figure 3:
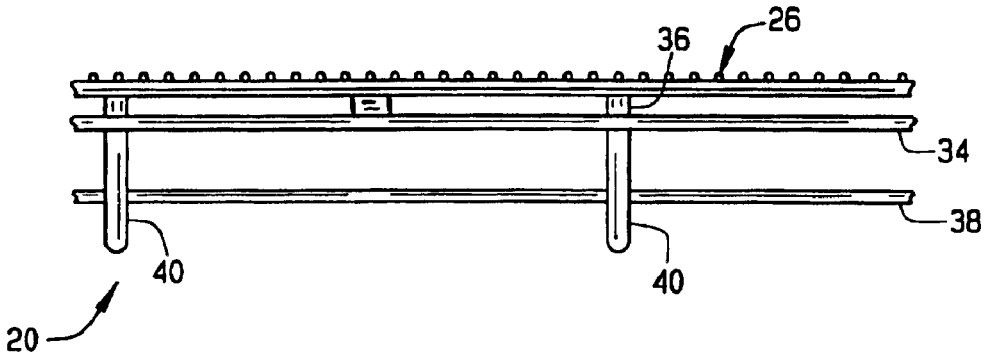
FIG. 3 is a front elevation view of a shelf having an integrated rod member connected thereto constructed according to the present invention.

A shelf (e.g., wire shelf unit) having a rod member connected thereto with integrated hooks is shown generally in FIGS. 1 through 3 and identified by reference numeral 20. The shelf 20 generally includes a plurality of transversely extending wire members 22 (i.e., wire stringers) supported by a plurality of longitudinally extending support members 24 to form a shelf deck 26. The transversely extending wire members 22 are typically spaced to provide a ventilated shelf deck 26 construction while preventing items from occupying the spaces 28 between the transversely extending wire members 22.

In a more preferred embodiment of the present invention, a plurality of longitudinally extending support members 24 are provided with one longitudinally extending support member 24*a* at a back or rearward end 30 (i.e., closest to a wall on which the shelf 20 is mounted), one longitudinally extending support member 24*c* at the front end 32 of the shelf 20, and one longitudinally extending support member 24*b* that is intermediate longitudinally extending support members 24*a* and 24*c*, and adjacent the front end 32. The front-most longitudinally extending support member 24*c* is connected to a lower longitudinally extending support member 34 with a plurality of vertically extending support members 36. A rod member 38 is connected to the shelf deck 26 (i.e., connected to the longitudinally extending support members 24*b* and 24*c*, and the vertically extending support members 36) using a plurality of integrated hooks 40 as described in more detail herein.

Figure 4:
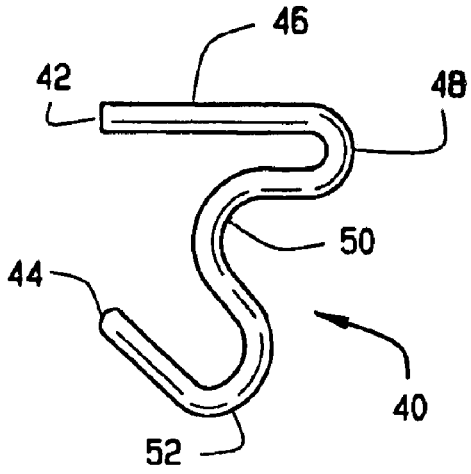
FIG. 4 is a side elevation view of a hook member of the present invention for connecting the rod member to the shelf.
Figure 6:
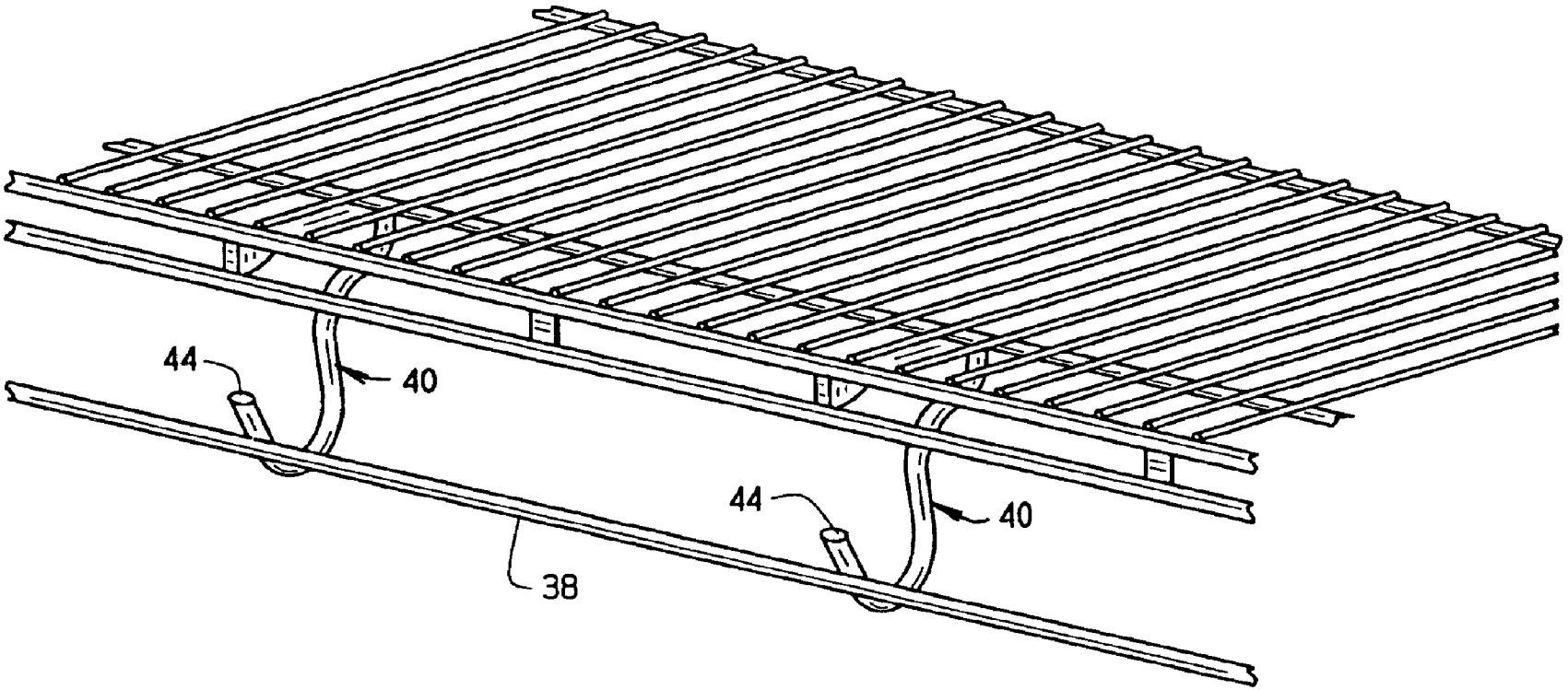
FIG. 6 is a top perspective view of a shelf having an integrated rod member connected thereto constructed according to the present invention.
Figure 7:
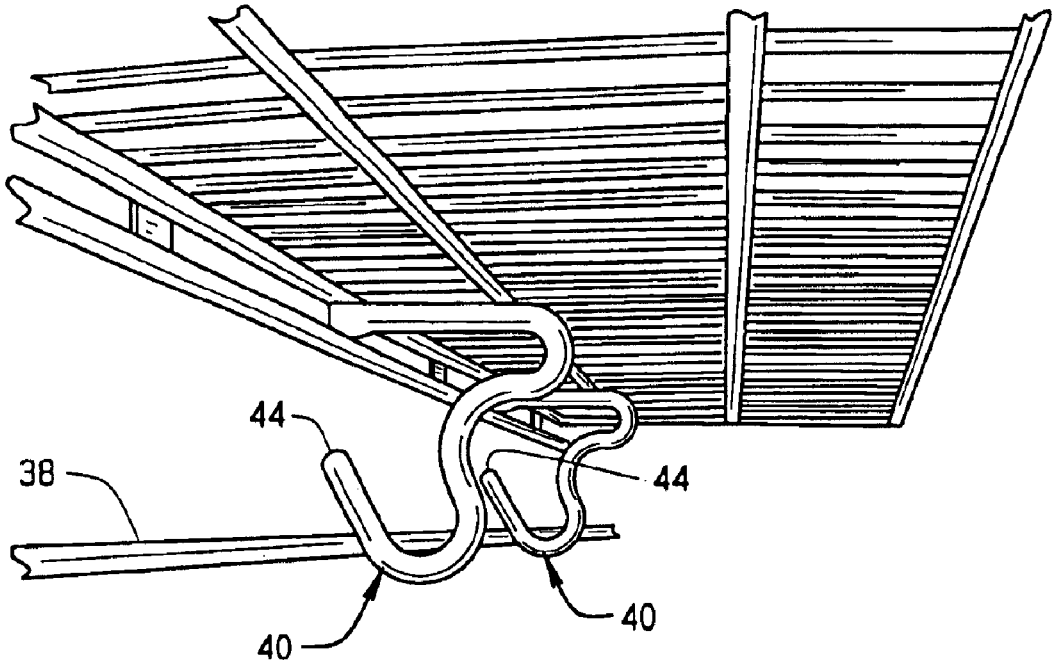
FIG. 7 is a bottom perspective view of a shelf a shelf having an integrated rod member connected thereto constructed according to the present invention.

In particular, and with respect to the hook member 40 as shown in FIG. 4, it is preferably constructed as a one piece member having a first end 42 and a second end 44. The first end 42 is preferably connected to support members 36, such as for example by welding, and the second end 44 is preferably connected to the rod member 38, such as, for example by welding. It should be noted that the second end 44 may extend past the support rod 38, with the support rod 38 secured at another point on the hook member 40, as shown in FIGS. 6 and 7. Further, the hook member 40 has a generally horizontal upper portion 46 positioned below the two front-most longitudinally extending support members 24*b* and 24*c*, and connected there at its front and back ends, respectively, by welding.

In a more preferred construction, the hook member 40 extends from the horizontal upper portion 46 to the second end 44 and configured having a first curved portion 48, a second curved portion 50 and a third curved portion 52. Specifically, the first and third curved portions 48 and 52 are generally configured in concave shape relative to the front end 32 of the shelf 20 and the second curved portion 50 is generally configured in a convex shape relative to the front end 32 of the shelf 20. In this embodiment, the first and second curved portions 48 and 50 are configured at about a forty-five degree angle relative to the shelf deck 26, and the third curved portion 52 is configured about perpendicular to the first and second curved portions 48 and 50. The hook member is generally planar, and the first end 42 and second end 44 are generally configured in the same vertical plane such that the rod member 38 is positioned generally below the lower longitudinally extending support member 34.

It should be noted that one or more additional longitudinally extending support members 24*d* may be provided, such as shown in FIG. 2 between the support members 24*a* and 24*c*. Further, the spacing of the hook members 40 and the number of hook members 40 provided may be modified based upon the particular shelf.

Figure 5:
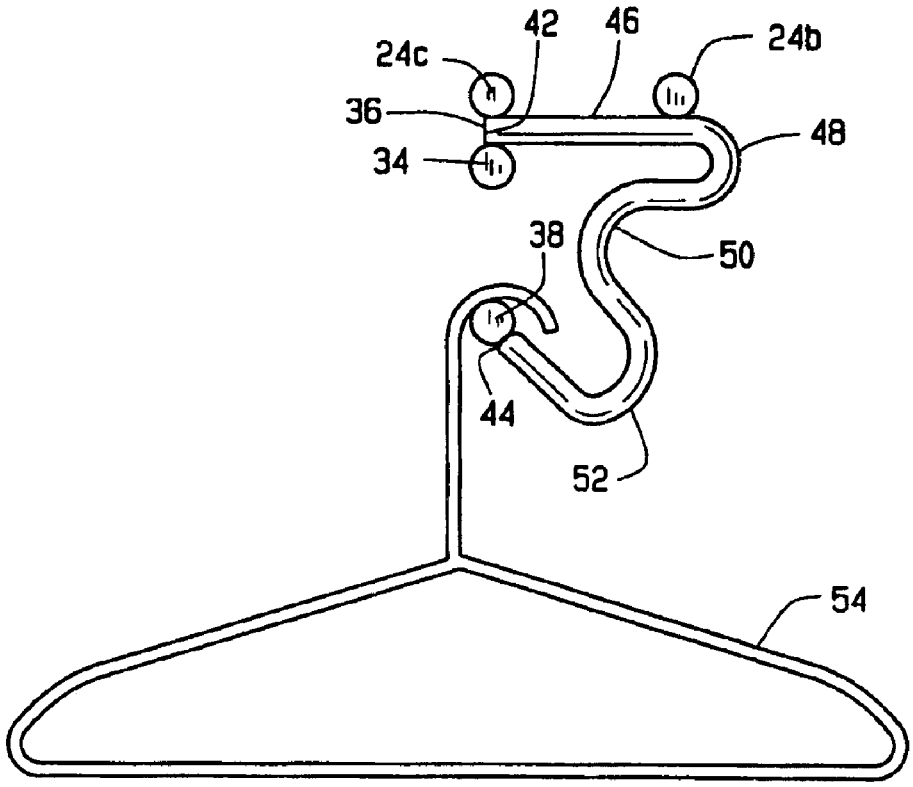
FIG. 5 is a side cross-sectional view of the shelf shown in FIG. 1 having a hanger supported thereon.

In operation, the shelf 20 provides a rod member 38 integrally connected to the shelf deck 26 (i.e., two longitudinally extending support members 24*b* and 24*c* and the vertically extending support members 36) with the plurality of hook members 40 such that items, for example clothing on hangers 54, may easily be placed and moved along the rod member 38. In particular, the third curved portion 52 is configured to accommodate items, such as hangers 54, sliding along the rod member 38 as shown in FIG. 5. Further, the connection of the hook member 40 to the two longitudinally extending support members 24*b* and 24*c* and the vertically extending support members 36 provides easier manufacture of the shelf 20 (i.e., assembly of the shelf 20 to hook members 40 and rod member 38 in a single operation) and reduces the likelihood of failure, for example, when hanging many bulky items on the rod member 38.

It should be noted that the hook members 40 of the present invention may be provided in connection with different shelf sizes, types and configurations and integrated therewith to provide a rod member 38 allowing for free sliding operation of items attached and connected (e.g., hanging) thereto.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A wire shelf comprising:

a plurality of wire stringers;

a plurality of support members, said plurality of support members including at least a front support member and a lower support member, said plurality of wire stringers and said plurality of support members forming a shelf deck; and a plurality of hook members configured for horizontal connection to the shelf deck and having a rod member connected thereto, at least one of said hook members having a first end connected between the front support member and the lower support member.

2. The wire shelf according to claim 1, wherein the hook members comprise a horizontal portion configured for connection to an intermediate support member.

3. The wire shelf according to claim 1, wherein the hook members are configured for connection to an intermediate support member.

4. The wire shelf according to claim 1, wherein a second end of the hook member is connected to the rod member.

5. The wire shelf according to claim 1, wherein the rod member is connected to the hook member such that a second end of the hook member extends beyond the rod member.

6. The wire shelf according to claim 1, wherein the hook members comprise a plurality of curved portions.

7. The wire shelf according to claim 6, wherein the hook members comprise three opposing curved portions.

8. A wire shelf having a rod integrally connected thereto comprising:

a plurality of wire stringers and support members forming a shelf deck, the plurality of support members including front, intermediate and lower support members; and a plurality of hook members connected to the front and intermediate support members and a first end of the hook member is connected between the front support member and the lower support member for maintaining the rod generally horizontally.

9. The wire shelf according to claim 8, wherein the hook members comprise a horizontal portion configured for connection to the front and intermediate support members.

10. The wire shelf according to claim 8, wherein a second end of the hook member is connected to the rod.

11. The wire shelf according to claim 8, wherein the rod member is connected to the hook member such that a second end of the hook member extends beyond the rod.

12. The wire shelf according to claim 8, wherein the hook members comprise a plurality curved portions.

13. The wire shelf according to claim 12, wherein the hook members comprise three opposing curved portions.

14. A wire shelf with integral rod, comprising a plurality of longitudinally extending support wires including a first longitudinally extending support wire adjacent a front of the shelf, a second longitudinally extending support wire below the first support wire, and connected to the first longitudinally extending support wire by a plurality of spaced vertically extending support members, and a third longitudinally extending support wire adjacent the first support wire;

a plurality of transversely extending wire stringers, said plurality of wire stringers and said plurality of support wires forming a shelf deck;

a longitudinally extending rod; and a plurality of hooks, each hook being secured to one of the plurality of vertical support members and the first and third support wires thereby supporting the rod.

15. The wire shelf according to claim 14, wherein the plurality of hooks comprise a concavely curved portion and a support surface to which the rod is secured, the concavely curved portion configured to allow hangers on the rod to slide past the plurality of hooks without interference.

16. A method of providing a wire shelf with an integrated rod, said wire shelf including a front support member, a lower support member positioned below the front support member, and an intermediate support member located horizontal to the front support member, the method comprising:

connecting a plurality of hook members to the front support member, the lower support member, and the intermediate support member; and supporting the rod using the plurality of hook members, said rod being positioned horizontally to a shelf deck of the wire shelf.

17. The method according to claim 16 further comprising configuring the hook members to have a plurality of curved portions.

18. The method according to claim 16 further comprising:

connecting a first end of the hook members between the front support member and the lower support member, wherein supporting the rod using the plurality of hook members includes connecting a second end of the hook members to the rod.

19. The method according to claim 16 further comprising:

connecting a first end of the hook members between the front support member and the lower support member, wherein supporting the rod using the plurality of hook members includes connecting the rod to the hook members such that a second end of the hook members extends beyond the rod.

20. A wire shelf having a rod integrally connected thereto comprising:

a plurality of wire stringers and support members forming a shelf deck, the plurality of support members including front, intermediate and lower support members; and a plurality of hook members having a horizontal top portion and a plurality of curved portions extending towards a rod support end, said horizontal top portion being connected to the front and intermediate support members, said rod support end being connected to the rod for maintaining the rod in a generally horizontal position;

wherein the hook members comprise three opposing curved portions.

21. A wire shelf having a rod integrally connected thereto, said wire shelf including a shelf deck and having a first and second longitudinally extending support members, said shelf comprising:

a plurality of hook members having a horizontal top portion with a first and a second end, the first end of the horizontal top portion being connected to the first longitudinally extending support member, the second end of the horizontal top portion being connected to the second longitudinally extending support member;

wherein the hook members comprise three opposing curved portions.

22. The wire shelf according to claim 21 wherein the plurality of hook members have a plurality of curved portions extending towards a rod support end, said rod support end being connected to the rod for maintaining the rod in a generally horizontal position.

* * * * *

UNITED STATES PATENT AND TRADEMARK OFFICE

CERTIFICATE OF CORRECTION

PATENT NO. : 7,004,335 B2
APPLICATION NO. : 10/235315
DATED : February 28, 2006
INVENTOR(S) : Lee E. Remmers It is certified that error appears in the above-identified patent and that said Letters Patent is hereby corrected as shown below:

CLAIMS 12

Column 4, line 65: insert "of" before "curved portions."

Signed and Sealed this

Twenty-second Day of August, 2006

JON W. DUDAS
*Director of the United States Patent and Trademark Office*